United States Patent [19]

Trenkler

[11] 3,934,119

[45] Jan. 20, 1976

[54] ELECTRICAL RESISTANCE HEATERS

[75] Inventor: George Trenkler, East Providence, R.I.

[73] Assignee: Texas Instruments Incorporated, Dallas, Tex.

[22] Filed: Sept. 17, 1974

[21] Appl. No.: 506,680

[52] U.S. Cl. ..... 219/543; 219/549; 252/511; 338/211

[51] Int. Cl.[2] ..... H05B 3/16

[58] Field of Search ..... 219/512, 528, 530, 543, 219/549; 252/511; 338/211, 212

[56] References Cited

UNITED STATES PATENTS

| | | | |
|---|---|---|---|
| 2,475,379 | 7/1949 | Stong | 219/543 X |
| 2,559,077 | 7/1951 | Johnson et al. | 219/543 |
| 2,624,823 | 1/1953 | Lytle | 219/543 X |
| 2,682,483 | 6/1954 | Erbe | 219/549 X |
| 2,853,589 | 9/1958 | Crooke | 219/543 |
| 2,859,321 | 11/1958 | Garaway | 219/543 X |
| 2,961,522 | 11/1960 | Hammer | 219/543 X |
| 3,387,248 | 6/1968 | Rees | 338/211 |
| 3,444,183 | 5/1969 | Hubbuch | 252/511 X |
| 3,491,056 | 1/1970 | Saunders | 252/511 X |

*Primary Examiner*—Volodymyr Y. Mayewsky
*Attorney, Agent, or Firm*—James P. McAndrews; John A. Haug; Russell E. Baumann

[57] ABSTRACT

An electrical resistance heater on a metal substrate. Bonded to a surface of the substrate is an insulating layer of a cured polyimide or polyamide-imide resin. A second layer of a cured polyimide or polyamide-imide resin having dispersed therein at least approximately 60% by weight of graphite flakes is bonded to the insulating layer. Intermediate and bonded to a portion of the insulating layer and an opposing portion of the second layer is an electrically conductive stripe which provides a high conductivity path to interconnect the second layer to an external electrical circuit. The stripe is formed from a cured polyimide or polyamide-imide resin having dispersed therein flakes of a conductive metal. The layers are flexible and the second layer and stripe have electrical conductivities which are not substantially degraded during operation at temperatures of at least 200°C. for extended periods of time.

7 Claims, 10 Drawing Figures

ELECTRICAL RESISTANCE HEATERS

BACKGROUND OF THE INVENTION

This invention relates to electrical resistance heaters and more particularly to such heaters formed in situ on metal substrates.

Electrically heated metal bodies have a wide variety of commercial and industrial uses, such as in thermostatic devices, thermal relays, time-delay relays, circuit breakers, etc. It is advantageous to have the electrically energized heater in good heat-exchange relation to the metal body, frequently a bimetal strip or disk, which changes its configuration as a function of temperature. Also, it is desirable to be able to supply such heater-metal units in various shapes and configurations at minimal expense. By providing a heater constituted by a relatively thin layer or coating applied on a surface area of the metal substrate to be heated, excellent heat transfer can be achieved. However, such heater layers are subjected to high temperatures for extended periods of time and in many applications must undergo repeated flexing. Epoxy resins mixed with graphite or other materials have been used for this purpose but at elevated temperatures, i.e., in the order of 200°C. or higher, these materials tend to degrade and deteriorate and fail to provide stable resistance characteristics necessary to long-term reliable functioning. Electrical resistance heater tapes and films have been made of polyimide and polyamide-imide resin compositions containing carbon particles, as disclosed in U.S. Pat. Nos. 3,444,183, 3,563,916, Belgium Pat. No. 630,749 and Netherlands application Ser. No. 6,511,346. There remains, however, a need for heater-metal composite units which will reliably function at elevated temperatures and economically provide for convenient supply of electrical current to the unit and flow through desired paths.

SUMMARY OF THE INVENTION

Among the several objects of this invention may be noted the provision of an electrical resistance heater bonded to a metal substrate surface which operates satisfactorily for extended periods of time at temperatures of at least about 200°C. without substantial degradation of its resistance characteristics, which will withstand flexing of the substrate, and to which electrical current is conveniently supplied for flow through desired paths; the provision of such heater on substrate units which are economical in cost and reliable in operation. Other objects and features will be in part apparent and in part pointed out hereinafter.

Briefly, the invention is directed to an electrical resistance heater on a metal substrate which comprises an insulating layer of a cured polyimide or polyamide-imide resin bonded to a surface of the substrate. A second layer of a cured polyimide or polyamide-imide resin, having dispersed therein at least approximately 60% by weight of graphite flakes, is bonded thereto. Intermediate and bonded to a portion of the insulating layer and an opposing portion of the second layer is an electrically conductive stripe which constitutes a high conductivity path to interconnect the second layer to an external electrical circuit. The stripe is formed from a cured polyimide or polyamide-imide resin having dispersed therein flakes of a conductive metal. The layers are flexible and the second layer and stripes have electrical conductivities which are not substantially degraded during operation at temperatures of at least 200°C. for extended periods of time.

BRIEF DESCRIPTION OF THE DRAWINGS

Corresponding reference characters indicate corresponding parts throughout the several views of the drawings.

DESCRIPTION OF PREFERRED EMBODIMENTS

Figure 1:
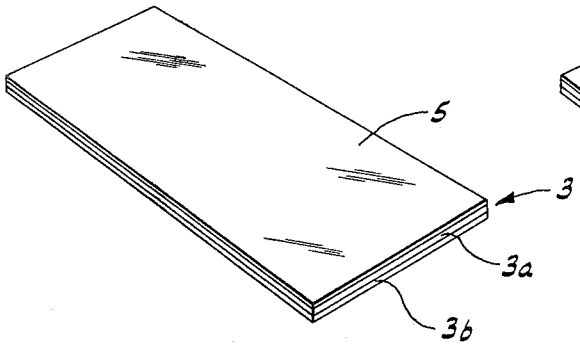
FIGS. 1–5 illustrate sequential steps in a process for fabricating an electrical resistance heater on a metal substrate made in accordance with the present invention.

Referring now to the drawings, a metal substrate constituted, for example, by a strip of bimetal is indicated at numeral 3. Strip 3 typically comprises a layer 3a of metal or an alloy having one thermal coefficient of expansion and a layer 3b of another metal or alloy bonded thereto and having a different thermal coefficient of expansion. Exemplary metallic layers are nickel-plated copper and stainless steel clad aluminum. The substrate, for example, may be 25–35 mils in thickness and has an exposed surface of layer 3*a* which does not oxidize at temperatures in the order of 200°C. That surface is cleaned by any of the conventional cleaning methods such as by abrading, a degreasing solvent (e.g., trichloroethylene), or ultrasonic cleaning, etc.

A thin layer 5 of a polyamic acid or polyamide-imide polymer, as formed by condensation reaction of an anhydride, such as pyromellitic dianhydride or trimellitic anhydride and an aromatic diamine, and dissolved in a solvent therefor, e.g., N-methyl pyrrolidone, is then applied by roller, doctor blade, brush, or silk screening, etc., to an exemplary thickness of 0.7 or 0.8 mil, preferably after wiping the substrate surface with N-methyl pyrrolidone. Such polyamic polymers are commercially available under the trademark "Pyre-ML" from E. I. DuPont de Nemours and Co., while polyamide-imide polymers are are commercially available under the trademark "AI-10" from Amoco Chemicals Corporation. The former is a viscous liquid of the polyamic acid dissolved in N-methyl pyrrolidone, while the latter polymer is in a dry particulate state ready for mixing with a desired amount of solvent. Both of these polymers may be converted into cured resins by heating as will be described hereinafter at prescribed temperature and time conditions. The polymer-solvent (e.g., 17% solids) layer is then dried for about 2 minutes at about 70°C. the temperature then being increased slowly up to about 150°C. for a total drying time of 7 minutes, the thickness of the dried film being about 0.1 mil. As a thicker layer is usually desired this process is repeated several times, but with the application of somewhat thicker polymer-solvent layers. A typical total thickness of dried insulating layer 5 is 1–1.5 mil. This dried uncured insulating polymer layer is then further heated to 250°C. for one hour to effect a partial curing.

A paste is then prepared from 2.7 g. of a mixture of polyamic acid (or polyamide-imide) polymer dissolved in N-methyl pyrrolidone (17% polymer by weight) and 3 g. of silver flakes (e.g., 40–50 micron particle size). This paste, containing approximately 87% by weight of silver, is silk-screened on the surface of the partially cured insulating layer 5 as illustrated at 7 of FIG. 2 to form a stripe about 3–5 mils in thickness. After drying at 40°C. for about 10 minutes and gradually increasing the temperature stepwise to 150°C. the solvent is evaporated and then the insulation layer, substrate, stripe assembly is heated to 250°C. for an hour to effect partial curing of the stripe 7 which has a final thickness of about 1.5–2.5 mils. The underlying insulating layer, while further cured, remains only partially cured. The resistivity of this conductive stripe is 0.2–0.3 Ω/ □ /0.001 inch. It will be understood that flakes of other conductive metals, such as nickel, or silver-copper alloys, may be used instead of silver.

Figure 2:
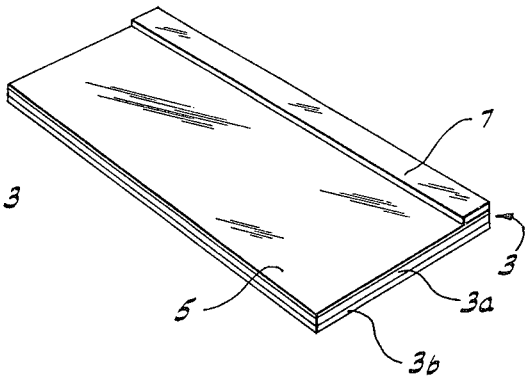
Figure 3:
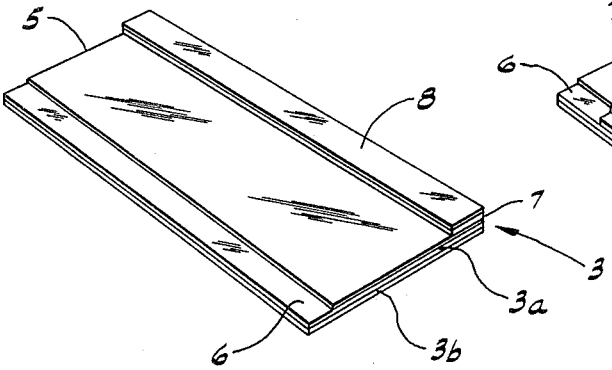

An electrical conductor is then temporarily attached to the exposed surface of stripe 7. A masking layer of a non-conductive coating (acrylic, polystyrene, etc.), that is not attacked by and is compatible with an electrolyte such as $CuSO_4$, is applied to the assembly except for stripe 7 which is left exposed. After rubbing the exposed surface of stripe 7 with steel wool or other abrasive, the assembly of FIG. 2 is immersed in a copper plating bath (e.g., 28 oz./gal. $CuSO_4$ and 7 oz./gal. $H_2SO_4$) and plated at a rate not greater than 10 amp./ft.$^2$ to form a thin conductive surface film 8 (FIG. 3) of copper on the exposed surface of stripe 7. The resistivity of the thus coated stripe is 0.002–0.008 Ω/ □ /0.001 inch. The protective masking coating is then removed by an appropriate solvent, and preferably a thin margin portion of the upper surface of layer 3a of substrate 3 is exposed as indicated at 6 (FIG. 3) by steel brushing or abrading so as to remove the overlying insulating layer 5 therefrom.

Figure 4:
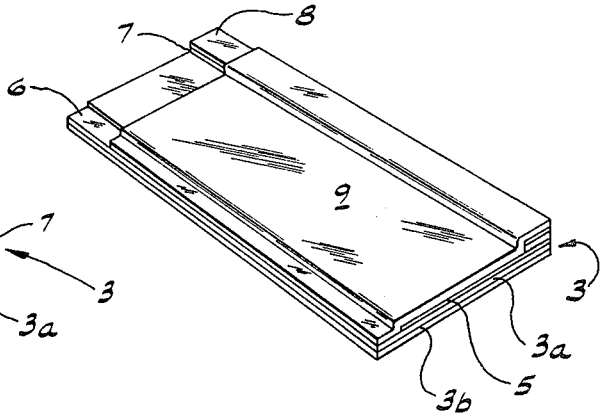

A second paste is then prepared from 3 g. of a mixture of polyamic acid (or polyamide-imide) polymer dissolved in N-methyl pyrrolidone (30–32% polymer by weight) and 2 g. of graphite flakes (−325 mesh-40 micron particle size), such as that obtainable under the trade designation "2134" from Superior Graphite Co.). This paste containing about 67% graphite was applied, preferably after washing the assembly of FIG. 3 with N-methyl pyrrolidone, by silk screening or brushing on the exposed surface of the FIG. 3 assembly to form a 3–5 mil thick coating. This coating after drying (as described above in regard to the conductive stripe 7) and partial curing by baking the assembly at 250°C. for an hour, constitutes an electrical heater layer 9 as shown in FIG. 4 having a thickness of about 1.5–2 mils. The resistivity of this heater layer 9 is about 200 Ω/ □ /0.001 inch. If a lower resistance, higher current-carrying heater layer 9 is desired, conductive metal flakes, e.g., silver or nickel, may be added when forming the heater paste. For example 5% by weight of silver flakes (of about 40 microns particle size), such as those obtainable under the trade designation "grade 750" from Alcan Metal Powders, when added to the heater paste described above, will reduce the resistivity thereof to about 70 Ω/ /0.001 inch. In accordance with this invention the resistance or conductivity of layer 9 may be adjusted or trimmed to provide a precise value by abrading the exposed surface of heater layer 9 to the extent desired. This adjusting or "trimming" of the resistance of layer 9 may be used to increase the resistance up to 20–25%.

As illustrated in FIG. 4, an exposed area of the conductive metal stripe surface 8 and an exposed area 6 of the substrate may be left exposed for securing electrical leads (not shown) for connection to electrical components and circuitry. Optionally, as shown in FIG. 5 a layer 10 of a polyamic acid or polyamide-imide polymer may be applied to the assembly of FIG. 4, as described above in regard to insulating layer 5 to partially or completely envelope the assembly which is then dried and partially cured in a similar manner.

It will be noted that the heater layer 9, the conductive stripe 7 and the insulating layer 5 are partially cured in varying degrees, inasmuch as these polymers require baking about 4 hours at 250°C. (or somewhat shorter periods of time at elevated temperatures above 250°C.) for full curing. However, as partially cured, the assembly may be put into use and after a relatively short period of time operating in its ultimate environment as a thermal relay, etc., all layers and stripes will soon become fully cured.

Figure 5:
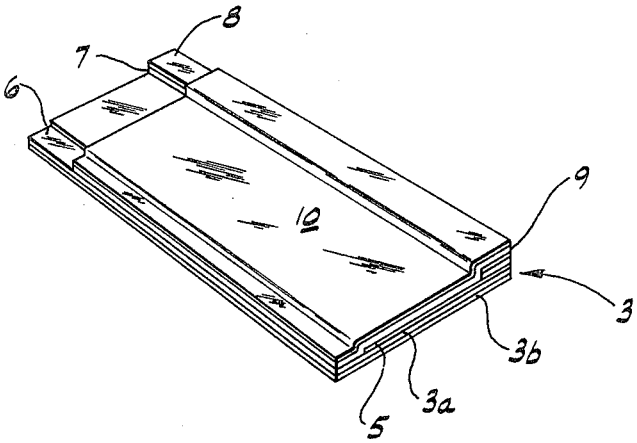
Figure 6:
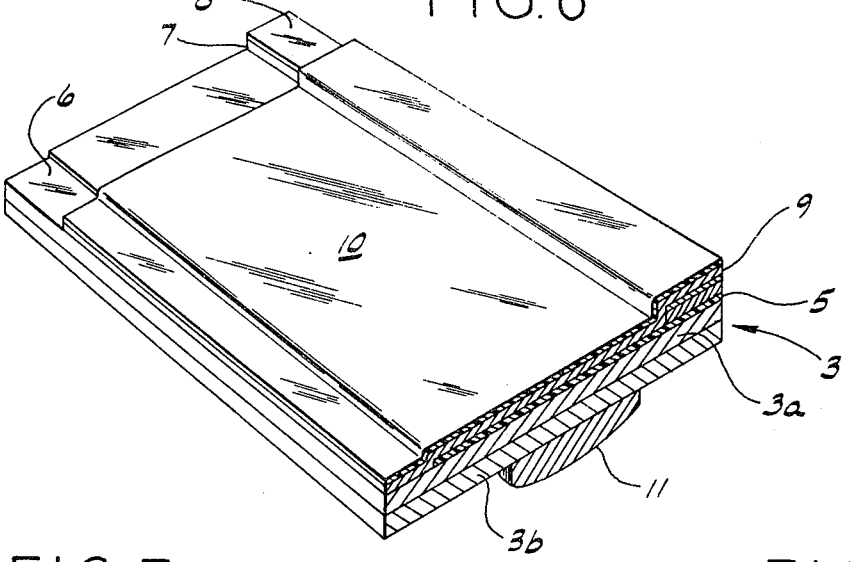
FIG. 6 is a perspective of a heater and bimetal composite illustrating the present invention.
Figure 7:
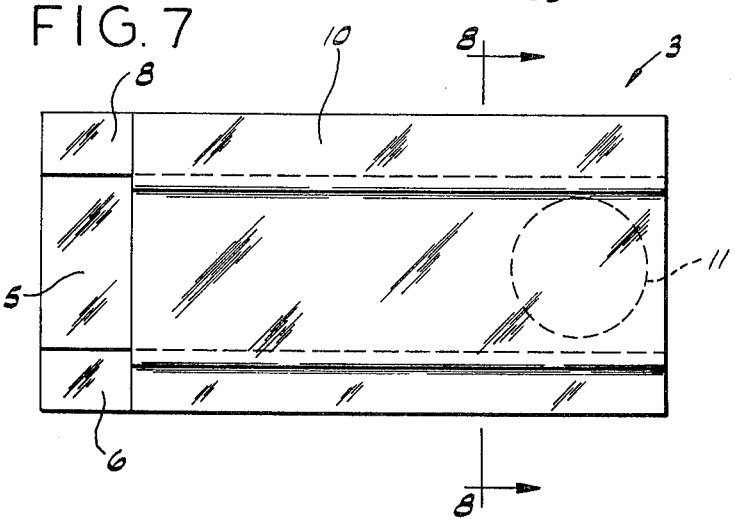
FIG. 7 is a plan view of the FIG. 6 composite.
Figure 8:
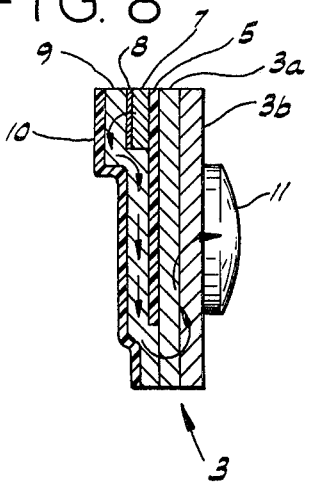
FIG. 8 is a cross-section on line 8—8 of FIG. 7.

A typical utilization of the heater and bimetal composite of FIG. 5 is as a switch arm for a circuit breaker such as illustrated in FIGS. 6–8 wherein a conventional electrical contact button 11 is secured, by welding preferably, to the undersurface of the heater on bimetal assembly of FIG. 5.

Figure 9:
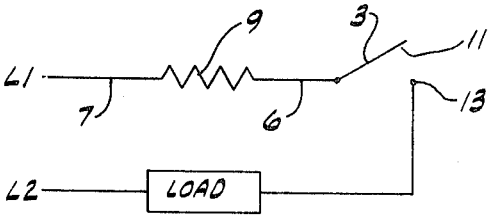
FIG. 9 is a circuit diagram of the composite of FIGS. 6–8 utilized in a low current circuit breaker for an electrical load.

FIG. 9 shows a low current circuit breaker utilizing such a heater on bimetal assembly to energize an electrical load from an electrical power source L1, L2, with L1 being electrically connected to the exposed portion of conductive stripe 7. The left end of the assembly as viewed in FIGS. 6 and 7 is secured to a base (not shown) so that it is cantilever-mounted thereon with contact 11 positioned for mating engagement with a fixed contact 13 also secured to the base. With layer 3b the higher expansion bimetal layer and contacts 11 and 13 normally engaged, the heater layer 9 will heat to a temperature which is a function of the load current flow therethrough. At a temperature corresponding to a predetermined level of overload current the differential expansion of layers 3a and 3b will cause contact 11 to move away from contact 13 thereby breaking the circuit to the load and providing overload protection. The current flow through the electrical resistance layer 9 is indicated by arrows in FIG. 8. As insulation layer 5 has good thermal conductivity and is quite thin and the major portion of electrical resistance layer 9 is in contact therewith, there is excellent thermal contact and heat transfer between heater 9 and bimetal strip 3. The conductive stripe 7 with its overlying conductive layer 8 provides a high conductivity path for the flow of electrical current into the resistance heater layer 9 and avoids any tendency for localized heating and possible separation of these layers because of localized areas of increased resistance along the bonded interface therebetween.

Figure 10:
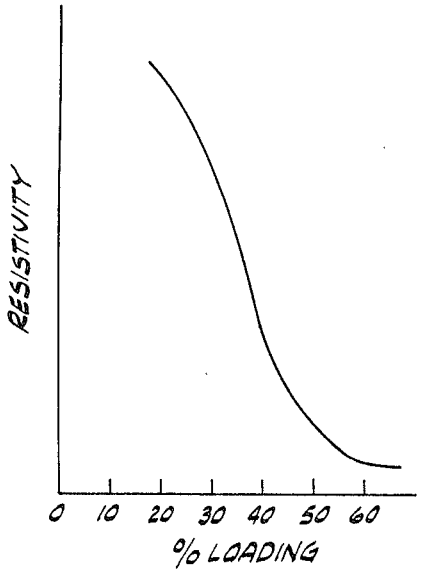
FIG. 10 graphically illustrates the relationship between the resistance of an electric heater on a metal substrate formed in accordance with this invention and the percentage of loading of a conductivity-modifying material.

The degree of loading of the graphite relative to the resistivity of the resulting heater layer 9 is represented in FIG. 10. It has been found in accordance with this invention that the percentage of weight of these particles should be at least 60% whereby the resistivity of the layer is essentially a function of the resistance of the particles themselves rather than partially a function of the resin material parameters as is the case where lower bonding or packing is employed. Similarly the concentration or loading of the conductive particles in stripe 7 is maintained at such high levels.

In view of the above, it will be seen that the several objects of the invention are achieved and other advantageous results attained.

As various changes could be made in the above constructions without departing from the scope of the invention it is intended that all matter contained in the above description or shown in the accompanying drawings shall be interpreted as illustrative and not in a limiting sense.

What is claimed is:

1. An electrical resistance heater on a flexible metal substrate comprising:

an insulating layer of a cured resin selected from the group consisting of polyimide and polyamide-imide resins bonded to a surface of said substrate;

a second layer having an electrical conductivity substantially greater than that of said insulating layer bonded at one side of said second layer to said insulating layer, said second layer comprising a cured resin selected from the group consisting of polyimide and polyamide-imide resins having dispersed therein at least approximately 60% by weight of graphite flakes, said second layer having spaced portions electrically connectable in an external electrical circuit for directing electrical current through said second layer; and at least one electrically conductive stripe bonded to one of said spaced portions of said second layer for providing flexible electrical connection of said one portion of said second layer in said external electrical circuit, said stripe comprising a cured resin selected from the group consisting of polyimide and polyamide-imide resins having dispersed therein flakes of a conductive metal;

said layers being flexible and said second layer and stripe having electrical conductivities which are not substantially degraded during operation at temperatures of at least 200°C. for extended periods of time.

2. An electrical resistance heater as set forth in claim 1 in which the second layer further includes at least about 5% by weight of conductive metal flakes dispersed together with the graphite flakes whereby an electrical resistance heater of a somewhat lower resistivity is provided.

3. An electrical resistance heater as set forth in claim 1 in which the conductive stripe has a coating of electrically conductive metal applied to the surface thereof in contact with the second layer.

4. An electrical resistance heater as set forth in claim 1 wherein said flexible metal substrate comprises a multilayer thermostat metal.

5. An electrical resistance heater as set forth in claim 1 wherein said other electrically connectable portion of said second layer is bonded to a portion of said metal substrate for facilitating electrical connection of said second layer in said external electrical circuit.

6. An electrical resistance heater as set forth in claim 4 wherein said electrically conductive stripe bonded to said one spaced portion of said second layer is disposed between portions of said second layer and said insulating layer and is further bonded to a portion of said insulating layer.

7. An electrical resistance heater as set forth in claim 6 having an additional insulating layer of a cured resin selected from the group consisting of polyimide and polyamide-imide resins bonded to said second layer at an opposite side of said second layer.

* * * * *